US011787619B2

(12) United States Patent
Bodet et al.

(10) Patent No.: US 11,787,619 B2
(45) Date of Patent: Oct. 17, 2023

(54) VALVE FOR PRESSURIZED CONTAINER

(71) Applicant: LINDAL FRANCE SAS, Val de Briey (FR)

(72) Inventors: Hervé Bodet, Verdun (FR); Eric Gaillard, Dieue sur Meuse (FR)

(73) Assignee: LINDAL FRANCE SAS, Val de Briey (FR)

( * ) Notice: Subject to any disclaimer, the term of this patent is extended or adjusted under 35 U.S.C. 154(b) by 0 days.

(21) Appl. No.: 17/626,872

(22) PCT Filed: Jul. 20, 2020

(86) PCT No.: PCT/EP2020/070489
§ 371 (c)(1),
(2) Date: Jan. 13, 2022

(87) PCT Pub. No.: WO2021/018656
PCT Pub. Date: Feb. 4, 2021

(65) Prior Publication Data

US 2022/0297925 A1 Sep. 22, 2022

(30) Foreign Application Priority Data

Jul. 29, 2019 (FR) ..... 1908612

(51) Int. Cl.
*B65D 83/48* (2006.01)

(52) U.S. Cl.
CPC ..... *B65D 83/48* (2013.01)

(58) Field of Classification Search
CPC ..... B65D 83/48; B65D 83/425; B65D 83/50; B65D 83/54; B65D 83/62
See application file for complete search history.

(56) References Cited

U.S. PATENT DOCUMENTS 3,593,887 A 7/1971 Morane
4,887,743 A * 12/1989 Blake ..... B65D 83/48 222/402.1

(Continued)

FOREIGN PATENT DOCUMENTS

CA 1168633 A1 6/1984
CA 2298517 A1 2/1999

(Continued)

OTHER PUBLICATIONS

International Search Report and Written Opinion dated Sep. 21, 2020 in corresponding application No. PCT/EP2020/070489; w/ English partial translation and partial machine translation (total 19 pages).

(Continued)

*Primary Examiner* — Vishal Pancholi
(74) *Attorney, Agent, or Firm* — Seckel IP, PLLC

(57) ABSTRACT

The valve (1) includes a valve body (10) having a cavity and bearing against a seal (40) provided with a central opening, and a seat (20) movable in the cavity, the seat bearing against the seal in the closed position and being spaced apart from the seal in the open position. The seat has a cavity bearing against the seal in the closed position, and spaced apart from the seal in the open position. A rod (60) is fixed in a non-detachable manner in the cavity, forming a seat/rod assembly, which rod is traversed, in its portion located inside the cavity, by windows (612) that open into the outlet channel, the free end of the rod protruding out of the cavity by passing through the central opening of the seal.

20 Claims, 5 Drawing Sheets

(56) References Cited

U.S. PATENT DOCUMENTS

Figure 1:
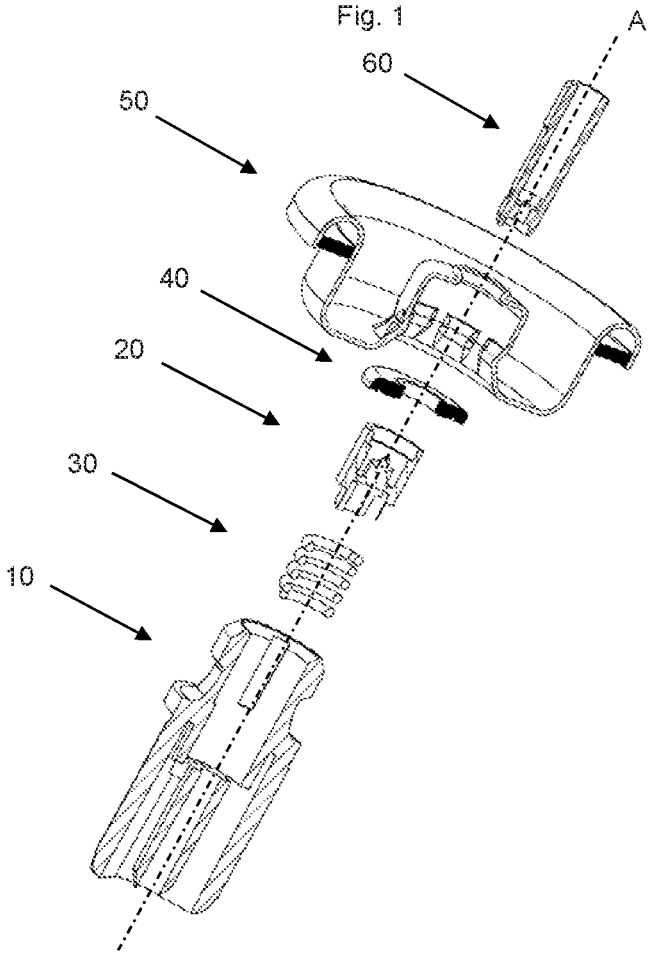

| | | | | |
|---|---|---|---|---|
| 5,906,046 | A | 5/1999 | Albplanalp et al. | |
| 6,092,698 | A | 7/2000 | Bayer | |
| 6,394,321 | B1 | 5/2002 | Bayer | |
| 8,317,062 | B2 | 11/2012 | Bodet et al. | |
| 8,505,775 | B2 | 8/2013 | Bodet et al. | |
| 9,192,948 | B2 | 11/2015 | Bodet et al. | |
| 9,403,636 | B2 | 8/2016 | Bodet et al. | |
| 10,532,881 | B2 | 1/2020 | Bodet et al. | |
| 2004/0124217 | A1* | 7/2004 | Yquel ..... | B65D 83/44 222/402.21 |
| 2009/0230344 | A1 | 9/2009 | Bodet et al. | |
| 2013/0037571 | A1 | 2/2013 | Bodet et al. | |
| 2013/0284293 | A1 | 10/2013 | Bodet et al. | |
| 2015/0353267 | A1 | 12/2015 | Bodet et al. | |
| 2018/0134481 | A1 | 5/2018 | Bodet et al. | |
| 2021/0237962 | A1 | 8/2021 | Bodet et al. | |

FOREIGN PATENT DOCUMENTS

| | | | |
|---|---|---|---|
| CA | 2366442 | A1 | 10/2000 |
| CA | 2469945 | A1 | 3/2003 |
| CA | 2652321 | A1 | 11/2007 |
| CA | 2811307 | A1 | 4/2012 |
| CA | 2896254 | A1 | 7/2014 |
| CA | 2988053 | A1 | 12/2016 |
| CA | 3099626 | A1 | 12/2019 |
| CA | 3126619 | A1 | 7/2020 |
| CA | 3142562 | A1 | 1/2021 |
| CA | 3147515 | A1 | 1/2021 |
| CH | 677197 | A5 | 4/1991 |
| EP | 1400465 | A1 | 3/2004 |
| FR | 3081530 | A1 | 11/2019 |
| WO | 2007132017 | A1 | 11/2007 |
| WO | 2012045562 | A1 | 4/2012 |
| WO | 2014111362 | A1 | 7/2014 |
| WO | 2016202754 | A1 | 12/2016 |
| WO | 2017115522 | A1 | 7/2017 |
| WO | 2019229004 | A1 | 12/2019 |
| WO | 2020152127 | A1 | 7/2020 |
| WO | 2020152141 | A1 | 7/2020 |
| WO | 2021013599 | A1 | 1/2021 |
| WO | 2021013605 | A1 | 1/2021 |

OTHER PUBLICATIONS

International Preliminary Report on Patentability dated Jul. 2, 2021 in corresponding application No. PCT/EP2020/070489; w/ English machine translation (total 27 pages).

Canadian Office Action and Search Report dated Feb. 17, 2022 in corresponding application No. CA3143113; w/English machine translation (total 12 pages).

* cited by examiner

VALVE FOR PRESSURIZED CONTAINER

The invention relates to a valve for a pressurized container, such as an aerosol generator, which valve comprises a valve body that has a cavity and that bears sealingly by a first end against a seal provided with a central opening, and a seat that is placed movable in translation in the cavity of the valve body and that is pushed against the seal by return means, the seat bearing sealingly against the seal in the closed position of the valve and being spaced apart from the seal by displacement in the cavity of the valve body against the effect of the force of the return means in the open position of the valve, the seat having a cavity delimited by a sealing edge, which sealing edge bears sealingly against the seal in the closed position of the valve, and is spaced apart from the seal in the open position of the valve.

Pressurized containers are generally constituted by a housing closed by a valve mounted on a cup. The product can be contained directly in the housing along with the propellant gas. It can also be contained in a bag, in order to be separated from this propellant gas.

The valves include at least one dispensing path through which the product must pass in order to leave the container. When the valve is closed, this dispensing path is closed by a seal that divides it into an upstream portion in contact with the inside of the container and a downstream portion in contact with the outside.

The valves are generally constituted by a valve body that has an interior cavity in direct fluidic connection with the inside of the container or of the bag, or in indirect fluidic connection, for example, via a metering reservoir. The cavity belongs to the upstream portion of the dispensing path. The cavity is closed at its top by the seal which makes it possible to close the dispensing path. A movable element is placed inside the cavity. It can move between a closed rest position, in which the product cannot leave the pressurized container, and an open position, in which the product can exit the container. In the closed position, the movable element cooperates with the seal to close the dispensing path. A spring placed in the cavity tends to maintain the movable element in the closed position. This mobile element is a stem in the case of a male valve or a seat in the case of a female valve.

In the case of male valves, the stem (also known as the rod or spray outlet) is constituted by a tubular conduit open at its top and closed at the other end. One or several radial orifices are made in the tubular wall, in a radial plane located near the closed end. The closed end of the stem is placed in the cavity of the valve body, whereas the free end protrudes out of the valve, in order to be actuated by a diffuser fitted over it. The inside of the tubular conduit belongs to the downstream portion of the dispensing path. In the closed position, the orifices are aligned with the seal placed at the top of the cavity of the valve body. The seal therefore blocks up all the openings. The inside of the valve body is then isolated from the outside by the seal. When pressure is exerted on the diffuser, the diffuser moves the stem downwards. The orifices move out of alignment with the seal and move down into the cavity. The product contained in the container can then pass into the cavity of the valve body, pass through the orifices thus freed, continue in the tubular conduit to leave the valve and enter the diffuser before being dispensed.

In the case of female valves, the movable element is a seat that bears annularly on the seal around a central opening of the seal. To open the valve, an actuating rod having a tubular shape must be introduced into the central opening of the seal. This actuating rod comes to bear on the seat and push it down. The seat is thus moved away from the seal and an annular passage is formed between the top of the seat and the seal, which passage brings in contact the inside of the cavity of the valve body and the outside via the actuating rod.

Male valves and female valves each have their advantages. In both cases, it is possible to fill the housing or the bag by passing through the valve. However, filling via the female valves is easier and faster, because the annular passage between the top of the seat and the seal has a much larger section than the few orifices made in the wall of the stem of the male valves and whose diameter is limited by the thickness of the seal and the stroke of the stem between the open position and the closed position.

Furthermore, during actuation, opening of a male valve is gradual, whereas opening of a female valve is almost instantaneous. This is due to the fact that the orifices of the stem disengage from the seal progressively as the stem is pushed down. On the contrary, in the case of the female valves, the seat is directly separated, immediately forming an annular passage. Likewise, when pressure on the movable element is removed, the female valve closes suddenly, whereas the male valve closes slowly. The product thus continues to flow momentarily, even though the user has stopped actuating the valve.

Despite this apparent superiority of female valves over male valves, many users prefer male valves, in particular because, when assembling the packaged product, it is easier to center the diffuser on the male valve due to the portion of the stem that protrudes above the male valve.

The objective of the invention is therefore to combine the advantages of male valves and those of female valves.

This objective is achieved with a valve according to the preamble, in which a stem (also known as rod or spray outlet) is fixed in a non-detachable manner in the cavity of the seat, forming a one-piece seat/stem assembly, which stem is composed of a tubular wall that surrounds an outlet channel open towards the end opposite to the seat, and that is traversed, in its portion located inside the cavity by one or several passage windows, the portion of the stem opposite to the seat and located beyond the passage windows protruding out of the cavity of the seat by passing through the central opening of the seal.

It is preferable

- that the seat comprises a tubular wall, a first end of which forms the sealing edge, said tubular wall being entirely closed, at a distance from the sealing edge, by a transverse wall, thus forming the cavity of the seat,
- that the lower portion of the tubular wall of the stem is dimensioned to penetrate into the tubular wall of the seat, and
- that an annular recess extending around the tubular wall of the stem is formed in the upper portion of the tubular wall of the seat which is located facing the passage windows of the stem, the annular recess extending up to the sealing edge. This annular recess extends the cavity of the seat radially.

It is preferable that the windows do not encroach on the seal. To this effect, it is preferable that the ends of the passage windows oriented towards the seal are flush with the face of the seal oriented towards the cavity of the seat and/or that said ends are located at a distance from said face of the seal. Concretely, when the valve is in the closed position, the windows can either extend up to the seal, or stop below and at a distance from the seal. When the valve is open, the windows are moved downwards and are in all cases at a distance from the seal. It would of course be possible that in the closed position of the valve, the upper portion of the windows penetrates over a portion of the height of the seal.

The stem can be fixed to the seat by any suitable means. Welding is a particularly well suited fixation method, in particular ultrasonic welding or rotary welding. A reserve of material for welding can be provided on the seat and/or on the stem.

The return means are preferably constituted by a spring. In order to stabilize the spring, it is preferable to provide the seat, opposite to its sealing edge, with a centering tenon around which one of the ends of the spring is positioned.

To facilitate fixing the stem in the cavity of the seat, a fixing stud can be placed in the cavity of the seat, on the transverse wall, the stem being fixed to the seat on the fixing stud, preferably on a front face thereof.

In a particular embodiment of the invention,

- the tubular wall of the stem is open at its two ends, a transverse wall being placed inside the tubular wall, between the passage windows and the end of the stem placed in the cavity of the seat, and at a distance from said end, an opening, preferably a through-opening, being made in the face of the transverse wall oriented towards the end located in the cavity,
- a centering projection is made on the fixing stud of the seat, preferably on its front face,
- the tubular wall of the stem, in its part located in the cavity of the seat, being dimensioned so that the fixing stud penetrates therein by the end, and the centering projection being dimensioned to penetrate in the opening made in the transverse wall.

The seal can be blocked against the upper edge of the valve body by a cup provided with an opening for the free end of the stem, wherein the cup can be crimped on an annular crown of the valve body.

The valve body can be equipped with

- a fastening tenon for fastening a dip tube or anti-collapse means; and/or
- a fixing wall for fixing a bag, said fixing wall surrounding the fastening tenon when there is one.

One or several longitudinal grooves can be made in the cavity of the valve body so that the product can more easily bypass the seat. The longitudinal groove or grooves preferably extend from the annular passage to at least the lowest position taken, when the valve is in the open position, by the end of the seat opposite to the sealing edge.

Figure 2A:
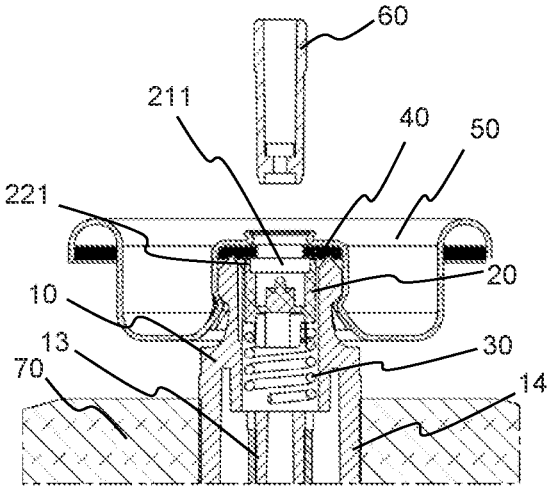
Figure 2B:
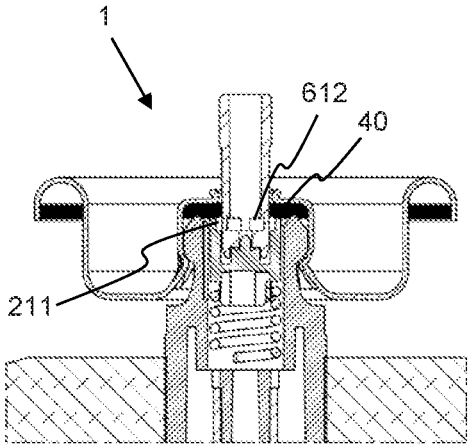
Figure 3A:
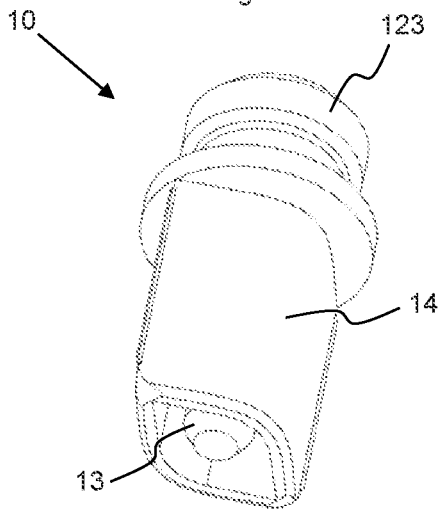
Figure 3B:
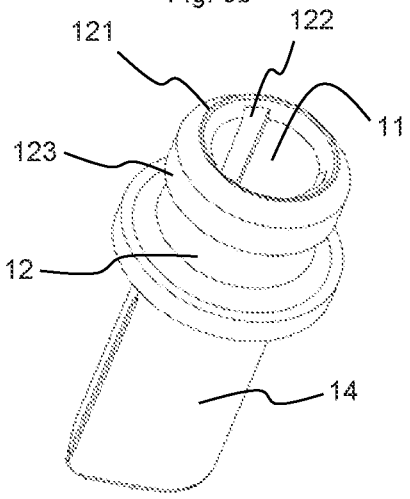
Figure 3C:
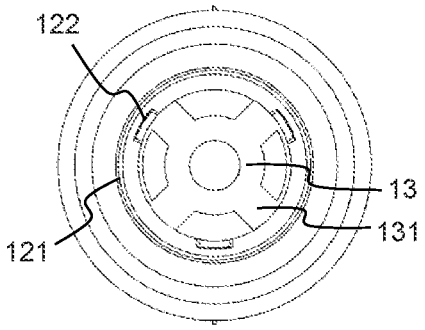
Figure 3D:
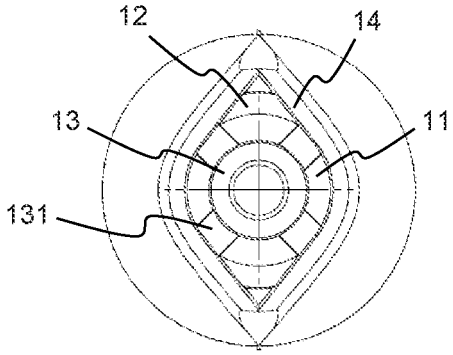
Figure 3E:
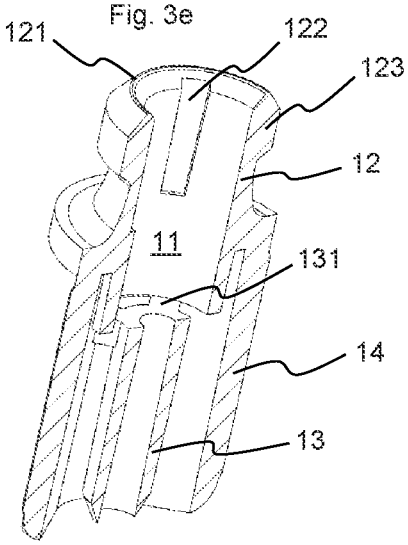
Figure 4A:
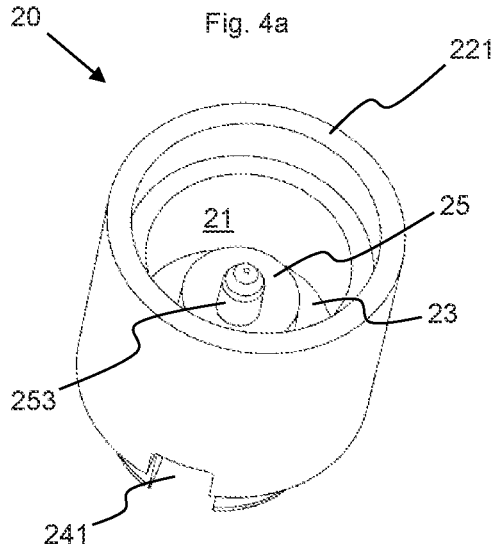
Figure 4B:
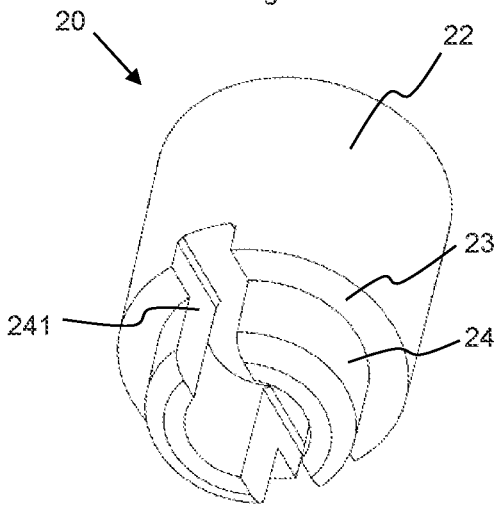
Figure 4C:
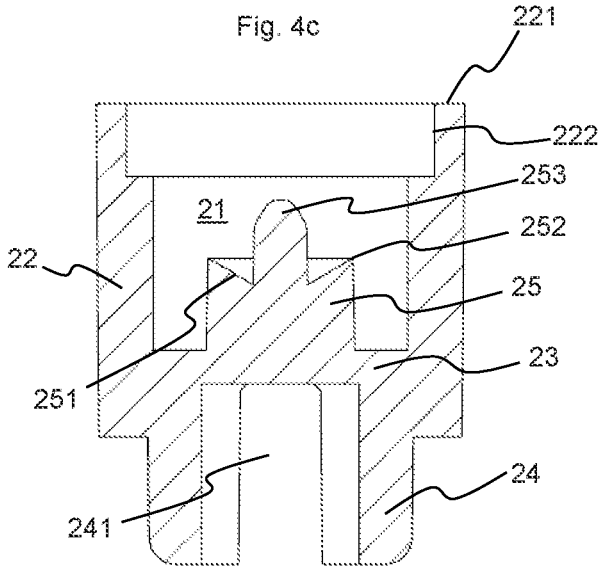
Figure 5:
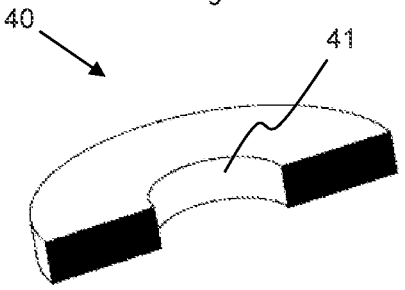
Figure 6A:
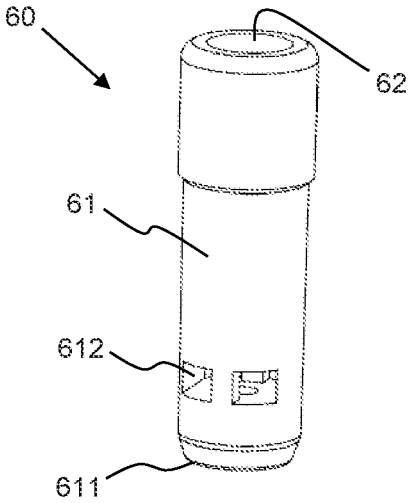
Figure 6B:
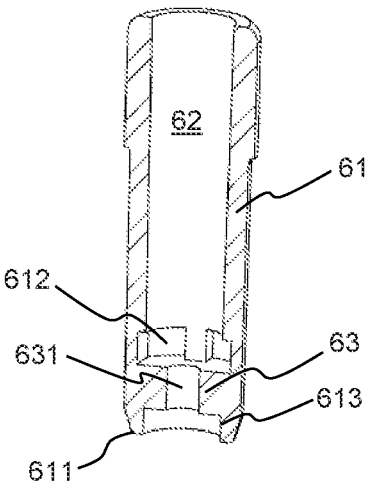
Figure 7:
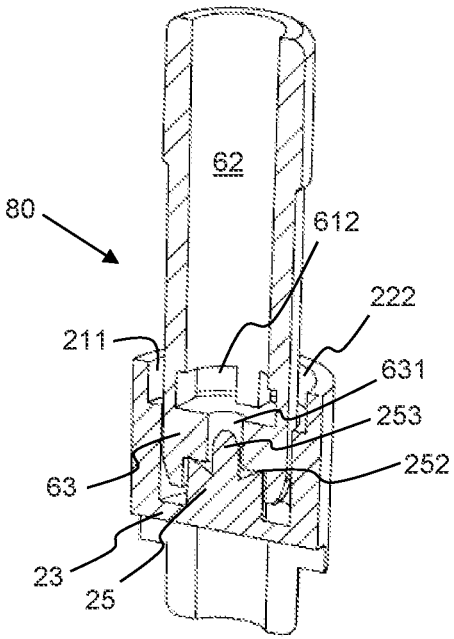
Figure 8:
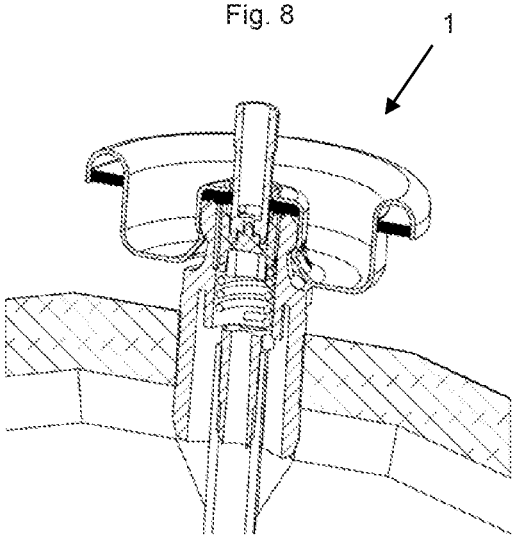
Figure 9A:
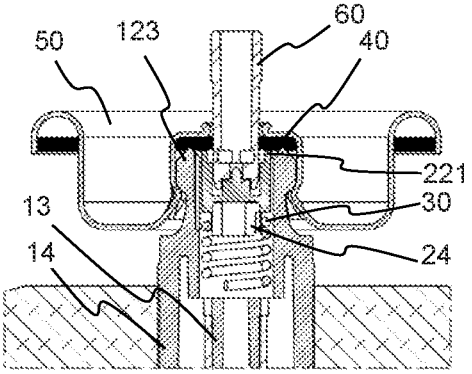
Figure 9B:
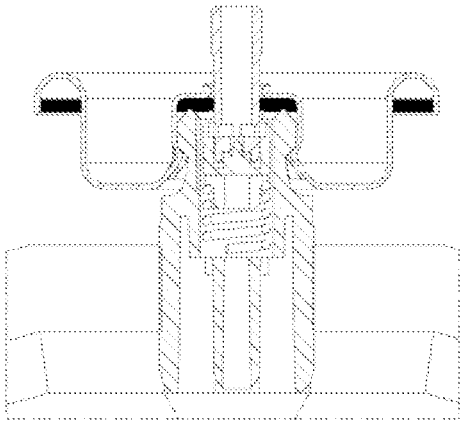
Figure 10A:
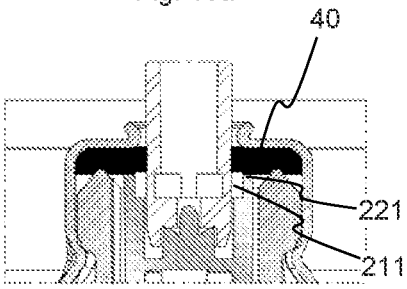
Figure 10B:
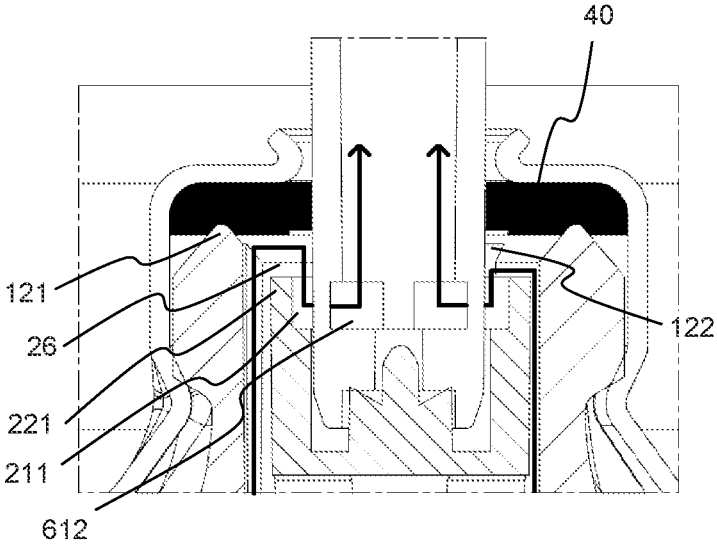

The invention is described in more detail with the assistance of an exemplary embodiment presented in the figures, which show:

FIG. 1: an exploded view of a valve according to the invention;

FIG. 2: a cross-section view of the valve of FIG. 1 (*a*) before and (*b*) after assembly of the stem;

FIG. 3: a view of the valve body (a) from below, (b) in perspective from above, (c) from above. (d) from below and (e) in cross-section and in perspective;

FIG. 4: a view of the seat (a) in perspective from above, (b) in perspective from below and (c) in cross-section and in perspective;

FIG. 5: a view of the seal in cross-section and in perspective;

FIG. 6: a view of the stem (a) in perspective and (b) in cross-section and in perspective;

FIG. 7: a cross-section view of the seat/stem assembly;

FIG. 8: a view of the valve of the invention in cross-section and in perspective;

FIG. 9: a cross-section view of the valve (a) in the closed position and (b) in the open position;

FIG. 10: An enlarged cross-section of the inside of the valve (a) in the closed position and (b) in the open position.

The invention relates to a valve (1), in particular a bag-on-valve, intended to close the housing of a pressurized container.

Conventionally, the valve is shown with the stem at the top, without this being limiting. The references "top"/"bottom" or "upper"/"lower" have only a relative value in relation to the representations of the attached figures. It is self-evident that in some cases, the valve can be used in other positions and that what is up in the position shown here will not necessarily be so during use. Furthermore, the valve in the assembled state extends along a main axis (A), which is vertical in the representations of the attached figures. The terms "radial", "axial" and "transverse" refer to this main axis (A).

The valve (1) shown here has all the attributes of a female valve. It is constituted mainly by a valve body (10) having a cavity (11) in which a seat (20) and a spring (30) are placed. The upper opening of the cavity (11) is closed by a seal (40). The cavity is in direct or indirect fluidic connection with the inside of the container. A cup (50) can be crimped onto the valve body (10), thereby blocking the seal (40). Unlike a female valve, the valve of the invention is also provided with a stem (60). If necessary, a bag (70) can be welded to the valve body (10).

The valve body (10) is constituted by a tubular wall (12) open at its two ends, which extends, in the assembled state of the valve, around the main axis (A). The inside of the tubular wall defines the cavity (11) of the valve body. The tubular wall preferably has substantially the shape of a cylinder of revolution. Its more tapered upper end forms an upper edge (121) that extends in a radial plane. Three grooves (122) are made in the inner face of the tubular wall. They extend in the longitudinal direction of the tubular wall, and thus substantially vertically in the present case. The grooves (122) extend from the tapered shape of the upper end (121) to at least the lowest position taken, when the valve is in the open position, by the lower end of the seat. The outer face of the tubular wall has, at the upper end, an annular crown (123) in the form of an extra thickness of material to allow crimping the cup (50) onto the valve body. A fastening tenon (13) for fastening an anti-collapse device or a dip tube is attached, for example by four bridges (131), to the lower end of the tubular wall (12). These four bridges (131) also perform the function of a stop for the spring (30). It would be possible not to provide a fastening tenon (13), in which case it would be preferable to provide a stop inside the tubular wall for the spring to bear against.

In order to be able to fix a bag on the valve, a fixing wall (14) is made on the tubular wall (12), below and at a distance from the annular crimping crown (123). This fixing wall surrounds the lower end of the tubular wall (12) and the fastening tenon (13). It preferably has a transverse cross-section in the shape of a flattened diamond, with the angles of the small diagonals being obtuse and rounded, and the angles of the large diagonals being acute and more pointed, as is clearly visible on FIG. 3*d*. This shape facilitates welding of the bag (70). If the valve is to be used without a bag, it is possible to dispense with this fixing wall (14).

The seat (20) of the invention is constituted by a bucket-shaped element having a cavity (21) delimited by a tubular wall (22) and a transverse wall (23) which is continuous and preferably radial. The tubular wall (22), when the seat is mounted in the valve, extends around the main axis (A). It preferably has substantially the shape of a cylinder of revolution. It is open at one of its ends, forming a sealing edge (221) that extends in a radial plane. The seat (20) is dimensioned to be able to penetrate entirely into the cavity (11) of the valve body while being able to slide freely therein. Concretely, the tubular wall (22) of the seat can slide parallel to the main axis (A) in the tubular wall (12) of the valve body.

The tubular wall (21) of the cavity has an upper portion (222) of larger diameter, which extends up to the sealing edge and forms an annular recess (211) around the cavity itself while extending it radially. The radial wall (23) closes the tubular wall (22), preferably at the end opposite to the sealing edge (221), so that the cavity (21) is only accessible through the opening defined by the sealing edge (221). The lower face of the radial wall (23) is extended by a centering tenon (24) for centering the spring (30). In order to save material and to facilitate handling of the seat during assembly, the centering tenon (24) is not solid, but constituted by two segments of a tubular wall. The slot (241) delimiting the two tubular segments extends in part in the lower face of the radial wall (23).

A fixing stud (25) is made on the upper face of the radial wall (23). It preferably had substantially the shape of a solid cylinder concentric with the tubular wall (22) of the seat. The front face (251) of the fixing stud, opposite to the radial wall, is preferably frustoconical with the top of the cone located at the bottom. The upper edge of the front face constitutes an annular reserve of material (252) for welding the stem. It is preferable to place, in the center of the front face of the fixing stud, a centering projection (253), which is preferably rounded at its top.

The geometry of the seat, and in particular its external size, must take into account the fact that a sliding movement inside the valve body from the top toward the bottom must be able to allow the valve to open. Conversely, a sliding movement of the seat from the bottom toward the top must be able to be performed easily inside the valve body to ensure rapid closing of the passage windows (612) by the seal (40) and closing of the valve to control product distribution.

The stem (60) is constituted by a tubular wall (61) that extends around the main axis (A) in the assembled state of the valve. This tubular wall (61) is open at its two ends and defines an outlet channel (62). The lower end (611) of the tubular wall is dimensioned to be able to penetrate into the cavity (21) of the seat. It is preferably tapered to facilitate its centering during its introduction into the cavity (21) of the seat. Above and at a distance from this lower end, a transverse and preferably radial wall (63) has been placed inside the outlet channel (62), so as to reduce its transverse cross-section, or even to block it. An orifice (631), open at least downwards, can be made in the radial wall. In the present example, the orifice (631) is a through-orifice. Large passage windows (612) are made in the tubular wall, above the radial wall (23). In the example shown here, there are four windows aligned two by two. These windows extend in a same radial plane, without necessarily being radial themselves.

The internal dimensions of the tubular wall (61), at least in its lower portion (613) located between the radial wall (63) and the lower end (611), are such that the fixing stud (25) can enter it without restraint. Likewise, the orifice (631) in the radial wall of the stem is dimensioned so that the centering projection (253) of the seat can enter it without constraint.

The seal (40) has a generally annular shape. The internal diameter of its central opening (41) is chosen so that it sealingly encloses the tubular wall (61) of the stem while allowing it to slide during actuation of the valve. The outer diameter of the seal is greater than the diameter of the upper edge (121) of the valve body. In the assembled position of the valve, the upper edge (121) bears sealingly against the seal (40).

The spring (30) performs the function of return means, making it possible to bring the seat back into abutment against the seal in order to close the valve.

According to the invention, the seat (20) and the stem (60) are fixed to each other to form a seat/stem assembly (80). To this effect, the stem is introduced by its lower end (611) into the cavity (21) of the seat until its radial wall (63) comes in contact with the upper portion of the frustoconical face (251) of the fixing stud forming a reserve of material. In this position, the centering projection (253) enters the opening (631) made in the radial wall (63) of the stem and the lower portion (613) of the tubular wall of the stem partially surrounds the fixing stud (25) of the seat. Welding is performed at this reserve of material (252). Welding can be carried out in different ways, in particular by ultrasound or by rotary welding (spin welding). As shown in FIG. 7, the large passage windows (612) of the stem open into the annular recess (211) of the seat cavity. The top of the passage windows (612) is located in the radial plane defined by the sealing edge (221) of the seat, or slightly below. This also means that, in the assembled state of the valve, the top of the passage windows (612) is flush with the seal (40), or is located slightly below. In the open position of the valve, the windows are in any case spaced apart from the seal. It would also be possible for the top of the windows to be located inside the seal, without however going above it.

The section of the outlet channel (62) and the section of the passage windows (612) are calculated so as not to create a restriction to the flow rate corresponding to the flow around the seat. In particular, the total transverse cross-section of the windows (612) and that of the outlet channel (62) are preferably of the same order of magnitude as, or even greater than, the narrowest transverse cross-section in the outlet path (122, 211) upstream of the windows. Furthermore, since the stem must be able to withstand a vertical compressive force allowing the valve to open, it is preferable to dimension the thickness of its wall to allow this force, without however limiting the section of the passage windows. A compromise must therefore be found to optimize the wall thickness of the stem and the resistance of the stem to vertical compression, while allowing clearance between the external diameter of the stem and the central opening of the cup through which it passes. The outer diameter of the stem in its upper portion located outside the valve body and above the horizontal plane formed by the central opening, or at least above the rounded upper portion of the cup, must allow the fixation of distribution means. In its lower portion, the external diameter of the stem must allow its introduction inside the seat.

It is not currently known how to mold such a seat/stem assembly (80) due in particular to the presence of passage windows (612) oriented radially and hidden behind the upper portion (222) of the tubular wall of the seat. It is therefore necessary to manufacture these two parts separately and to assemble them afterwards.

Depending on needs, it is possible, in a preliminary step, to fasten an anti-collapse device or a dip tube to the fastening tenon (13) and/or to fix a bag (70) on the face of the fixing wall (14) before folding or rolling it around the main axis (A).

The valve is assembled as follows. The spring (30) is introduced in the cavity (11) of the valve body (10) until its lower end rests on the bridges (131) for fixing the tenon (13). The seat (20) is then introduced so that its centering tenon (24) penetrates inside the spring (30) and that its cavity is open upwards. The spring is thus sandwiched between the fixing bridges (131) of the valve body at the bottom and the underside of the radial wall (23) of the seat at the top. The seal (40) is then placed at the top of the valve body (10), with the upper edge (121) of the valve body resting on the seal. The cup (50) is then placed on and around the annular crown (123) of the valve body, with its central opening centered on the main axis (A) and on the central opening (41) of the seal. The cup is then crimped by bearing under the annular crown (123) of the valve body. The stem (60) is then introduced by its lower end (611) into the cavity (21) of the seat, passing through the central opening of the cup and the central opening (41) of the seal. The stem is then welded to the seat, for example by ultrasound. It would also be possible to make the seat/stem assembly (80) first, before assembling the valve. When the stem is welded after assembly of the valve, it must be taken into account that welding requires application of a downward vertical force to maintain sufficient contact between the weld zone of the stem and the reserve of material supplied by the fixing tooth of the seat. It is therefore preferable to size the spring (30) so that it exerts a countering pressure greater than that applied during the welding, so as not to allow the seat/stem system to be pushed down into the valve body during the fixation of the two components to one another.

The grooves (122) extend from the tapered portion of the upper end of the valve body to below the lower face of the radial wall (23) of the seat when it is spaced apart from the seal in the open position of the valve. As can be seen in FIG. 10, the grooves do not extend to the top edge (121), in order to avoid sealing problems.

At any time, the upper edge (121) of the valve body bears sealingly on the seal (40). In the closed rest position of the valve, the sealing edge (221) of the seat also bears sealingly against the seal, the seat being pushed back by the spring.

As in a traditional male valve, the stem passes through a central opening of the cup and protrudes outside the valve, and as in a female valve, sealing is achieved, when the valve is in the closed rest position, at the sealing edge (221) of the seat that bears sealingly against the lower face of the seal (40).

The valve of the invention operates as follows. Pressure is exerted on the upper end of the stem (60) of the seat/stem assembly (80), by using a diffuser for a male valve fitted onto the protruding portion of the stem. The seat/stem assembly (80) is moved downwards against the effect of the spring (30). The sealing edge (221) of the seat is then moved away from the seal and an annular passage (26) is formed between the sealing edge (221) of the seat and the lower side of the seal, as is clearly visible on FIG. 10. Under the effect of the pressure difference between the pressure inside the pressurized container and atmospheric pressure, the product contained inside the container enters into the bottom of the cavity (11) of the valve body, bypassing the fixing bridges (131) and/or through a dip tube attached to the fastening tenon (13). It then moves up within the cavity (11) of the valve body by passing along the spring (30), bypasses the tubular wall (22) of the seat while passing through the grooves (122), passes through the annular passage (26), enters into the annular recess (211) of the seat cavity, passes through the passage windows (612), and enters into the outlet channel (62).

As soon as the pressure applied to the stem is released, the spring (30) pushes the seat/stem assembly (80) back upwards until the sealing edge (221) of the seat is again in sealing contact against the lower face of the seal (40). The outlet path of the product is then interrupted at this interface.

The valve of the invention differs from a traditional male valve in that the passage windows (612) of the stem always remain open and do not need to be closed by the seal. Whatever the position of the valve, the passage windows bring in contact the outside of the valve and the cavity (21) of the seat via the outlet channel (62) of the stem. The passage windows are always located underneath the seal. Their dimensions are therefore not imposed by the thickness of this seal, unlike the passage openings of a traditional stem. It is therefore possible to provide passage windows that are much larger, and in particular, higher. It is sufficient to adjust the height of the annular recess (211) of the seat cavity to the desired height of the windows (612). With the valve of the invention, the filling speed via the valve is much faster than with a traditional male valve, and approaches that of a female valve. The valve of the invention is therefore particularly well suited to viscous products and/or to rapid filling via the valve.

The valve of the invention combines the advantages of female valves (quick opening and closing, large passage windows) and those of male valves (stem protruding from the valve for easier centering of the diffuser).

The valve of the invention is particularly intended for use as a bag-on-valve. However, it is possible to use it without a bag.

In the example presented here, the valve is of the traditional type with a metal cup crimped thereon. The seat/stem assembly (80) can however be used in any other type of valve, and in particular in so-called "all plastic" valves where the cup is made of plastic and the valve body is snapped onto the cup or is an integral part thereof. The seat/stem assembly (80) can in particular be applied to valves of the type of those described in patent applications WO 2016/202 754 A1 or FR 18 54 513.

The seat and the stem can be made, for example, of POM (polyoxymethylene) or of PA (polyamide). The material chosen must be compatible with the product to be dispensed. For example, the valve body can be in POM or, if a bag has to be welded thereon, in PE (polyethylene) or in PP (polypropylene).

LIST OF REFERENCES

1 Valve
10 Valve body
11 Cavity
12 Tubular wall
121 Upper edge
122 Grooves
123 Annular crown
13 Fastening tenon
131 Fixing bridges
14 Bag fixing wall
20 Seat
21 Cavity
211 Annular recess
22 Tubular wall
221 Sealing edge
222 Upper portion
23 Radial wall
24 Centering tenon
241 Slot
25 Fixing stud
251 Upper face

252 Extra thickness of material
253 Centering projection
26 Annular passage
30 Spring
40 Seal
41 Central opening
50 Cup
60 Stem (or rod)
61 Tubular wall
611 Lower end
612 Passage windows
613 Lower portion
62 Outlet channel
63 Radial wall
631 Opening
70 Bag
80 Seat/stem (seat/rod) assembly

The invention claimed is:

1. A valve for pressurized container, comprising:

a valve body having a cavity, a seal provided with a central opening, the valve body bearing sealingly by a first end against the seal, a seat placed movable in translation in the cavity of the valve body, and return means, the seat being pushed against the seal by the return means, wherein the seat bears sealingly against the seal in the closed position of the valve and is spaced apart from the seal by displacement in the cavity of the valve body against the effect of the force of the return means in the open position of the valve, wherein the seat has a cavity delimited by a sealing edge bearing sealingly against the seal in the closed position of the valve and spaced apart from the seal, forming an annular passage, in the open position of the valve, and wherein a rod is fixed in a non-detachable manner in the cavity of the seat, forming a one-piece seat/rod assembly, the rod comprising a tubular wall surrounding an outlet channel and traversed in a portion thereof located inside the cavity by one or several passage windows that open into the outlet channel, a free upper end of the rod located beyond the passage windows protruding out of the cavity of the seat by passing through the central opening of the seal, wherein a fixing stud is placed on a transverse wall in the cavity of the seat, the transverse wall being oriented transversely to a main longitudinal axis of the cavity of the seat, the fixing stud being oriented along the main longitudinal axis of the cavity of the seat, the rod being positioned so that the fixing stud penetrates in the tubular wall at a lower end of the rod opposite the free upper end of the rod.

2. The valve according to claim 1, wherein the seat comprises a tubular wall, a first end of the tubular wall forming the sealing edge, the tubular wall being entirely closed at a distance from the sealing edge by the transverse wall, wherein the lower portion of the tubular wall of the rod is dimensioned to penetrate into the tubular wall of the seat, and wherein an annular recess extending around the tubular wall of the rod is formed in an upper portion of the tubular wall of the seat which is located facing the passage windows of the stem, the annular recess extending up to the sealing edge.

3. The valve according to claim 1, wherein, in the closed position of the valve, ends of the passage windows oriented towards the seal are flush with, located at a distance from, or both flush with and located at a distance from a face of the seal oriented towards the cavity of the seat.

4. The valve according to claim 1, wherein the rod is fixed to the seat by welding.

5. The valve according to claim 1, wherein the return means comprise a spring, and wherein the seat has, opposite to the sealing edge thereof, a centering tenon around which one of the ends of the spring is positioned.

6. The valve according to claim 2, wherein the rod is fixed to the seat on the fixing stud.

7. The valve according to claim 6, wherein the tubular wall of the rod is open at both the lower end and the upper end thereof, a transverse wall being placed inside the tubular wall, between the one or several passage windows and the lower end placed in the cavity of the seat, and at a distance from the lower end, an opening being made in a face of the transverse wall oriented towards the lower end, a centering projection is made on the fixing stud of the seat, and the centering projection penetrates in the opening made in the transverse wall.

8. The valve according to claim 1, wherein the seal is blocked against the edge of the valve body by a cup provided with an opening for a free end of the rod.

9. The valve according to claim 1, wherein the valve body is provided with:

a fastening tenon for fastening a dip tube or anti-collapse means;

a fixing wall for fixing a bag; or a fastening tenon for fastening a dip tube or anti-collapse means and a fixing wall surrounding the fastening tenon.

10. The valve according to claim 1, wherein one or several longitudinal grooves are made in the cavity of the valve body.

11. The valve according to claim 4, wherein the rod is fixed to the seat by ultrasonic welding.

12. The valve according to claim 4, wherein the rod is fixed to the seat by rotary welding.

13. The valve according to claim 4, wherein a reserve of material for welding is provided on the seat, on the rod, or both on the seat and on the rod.

14. The valve according to claim 6, wherein the rod is fixed to the seat on a front face of the fixing stud.

15. The valve according to claim 7, wherein the opening in the transverse wall of the tubular wall of the rod is a through-opening.

16. The valve according to claim 7, wherein the centering projection is made on a front face of the fixing stud of the seat.

17. The valve according to claim 7, wherein the opening in the transverse wall of the tubular wall of the rod is a through-opening and the centering projection is made on a front face of the fixing stud of the seat.

18. The valve according to claim 10, wherein the longitudinal groove or grooves extend from the annular passage to at least a lowest position taken by the end of the seat opposite to the sealing edge when the valve is in the open position.

19. The valve according to claim 2, wherein, in the closed position of the valve, ends of the passage windows oriented towards the seal are flush with, located at a distance from, or both flush with and located at a distance from a face of the seal oriented towards the cavity of the seat.

20. The valve according to claim 2, wherein the rod is fixed to the seat by welding.

* * * * *